US005522436A

United States Patent [19]

Tabuchi et al.

[11] Patent Number: 5,522,436

[45] Date of Patent: Jun. 4, 1996

[54] WIRING HARNESS ASSEMBLING BOARD AND BAND CLAMP BINDING EXAMINING DEVICE THEREFOR

[75] Inventors: Motoaki Tabuchi, Kanazawa; Masanori Inaba, Yokkaichi, both of Japan

[73] Assignee: Sumitomo Wiring Systems, Ltd., Japan

[21] Appl. No.: 246,627

[22] Filed: May 20, 1994

[30] Foreign Application Priority Data

May 24, 1993 [JP] Japan ..... 5-121644
May 24, 1993 [JP] Japan ..... 5-121645

[51] Int. Cl.[6] ..... B21F 15/06

[52] U.S. Cl. ..... 140/92.1; 29/755; 140/93 A

[58] Field of Search ..... 140/92.1, 93 R, 140/93 A; 29/755

[56] References Cited

U.S. PATENT DOCUMENTS 3,340,904 9/1967 Gage et al. .
4,531,283 7/1985 Kitchens et al. ..... 29/755
4,662,408 5/1987 Zajac .
4,711,025 12/1987 DeSanto ..... 29/755

FOREIGN PATENT DOCUMENTS 3-3508 1/1991 Japan .
3-3516 1/1991 Japan .
WO92/19501 11/1992 WIPO .

*Primary Examiner*—Lowell A. Larson
*Attorney, Agent, or Firm*—Beveridge, DeGrandi, Weilacher & Young

[57] ABSTRACT

A wiring harness assembling board 10 is provided with positioning members 20. In binding band clamps by a band clamp binder, the band clamp binder is engaged with the positioning members 20 to position the band clamp binder. If the band clamp binder is engaged with the positioning members 20, signals are sent to a clamp binding examining device 60 from operating pins 21 through signal lines 22. In the clamp binding examining device 60, the signals are counted, to inform a worker of passing when the number of signals becomes a predetermined number. As a result, it is possible to satisfactorily prevent the band clamps from not being bound by the band clamp binder.

9 Claims, 8 Drawing Sheets

W
40
41
37
36
50
47
42
30
46
49
32
20
21
24
L
H
35
51
52

WIRING HARNESS ASSEMBLING BOARD AND BAND CLAMP BINDING EXAMINING DEVICE THEREFOR

BACKGROUND OF THE INVENTION

1. Field of the Invention

The present invention relates to a wiring harness assembling board having a band clamp binding indicating structure and a band clamp binding examining device which is applicable to the assembling board. More particularly, it relates to a wiring harness assembling board capable of binding, when band clamps are bound using a band clamp binder, the band clamps satisfactorily and a binding examining device for examining whether or not the binding of the band clamps on the assembling board is completed.

2. Description of the Related Art

A wiring harness for an automobile, for example, is one obtained by bundling a lot of electric wires, terminals, connectors and the like systematically disposed. A band clamp (also referred to as a "belt clamp") is bound in a predetermined place of a bundle of electric wires. The band clamp is used in fixing the wiring harness to the automobile and must be bound in a predetermined position of the bundle of electric wires. If the binding position of the band clamp is shifted from a predetermined position, the positions of a clamp insertion hole formed in the body of the automobile and the band clamp do not coincide with each other in fixing the wiring harness to the automobile, thereby making it impossible to fix the wiring harness to the automobile.

Conventionally, binding work for binding the band clamp on the bundle of electric wires has been generally performed by hand. Specifically, an indicating member for indicating the binding position of the band clamp is provided on an assembling board and the band clamp is bound in the position indicated by the indicating member by hand.

If the binding work of the band clamp is performed by hand, however, the wiring harness cannot be efficiently assembled. Therefore, an automatic band clamp binder for automatically performing binding work has been proposed (see Japanese Utility Model Laid-Open Gazette No. 3508/1991).

If the automatic binder is used, however, it is difficult to accurately bind the band clamp on the indicated binding position as in the case of binding the band clamp by hand even if there is an indicating member for indicating the binding position. The reason for this is that the automatic binder must be operated with both worker's hands because it is bulky and significantly heavy, thereby making it difficult to cause the binding position of the band clamp to accurately coincide with the indicated position at the time of the operation.

In order to solve such a problem, a guiding member for guiding a band clamp at the time of the binding work of the band clamp using an automatic binder has been proposed in Japanese Utility Model Laid-Open Gazette No. 3516/1991. A guiding member 1 proposed in the official gazette is disposed on an assembling board 2, as shown in FIG. 8, to hold electric wires W, similarly to another wire laying-out holding member 3. A guide groove 4 for guiding the band clamp is formed in the guiding member 1, as shown in FIG. 9.

Meanwhile, a large number of wire laying-out holding members are actually studded on the wiring harness assembling board. Some holding members are required for all assembling processes, and more than a few holding members are required in particular assembling processes but are not required in the other assembling processes. For example, if a wiring harness is a set of ten electric wires, some holding members are required only when after eight electric wires are laid out. If the remaining two wires are laid out, this may, in some cases, interfere with the first laying-out work performed when the eight wires are laid out. Alternatively, some holding members are required at the time of laying out electric wires but interfere with work for winding a tape around the electric wires when they have been laid out.

On the assembling board, therefore, holding members which are not always required can be conventionally inclined or caused to rise and fall. Consequently, the efficiency of assembling work is increased in such a manner that only necessary holding members stand.

In consideration of the practice of such wiring harness assembling work, it is not very preferable to stud the above described guiding member 1 shown in FIG. 9 on the assembling board 2. The reason for this is that at the time of electric wire laying-out work, tape winding work, protector mounting work and the like performed prior to the band clamp binding work, the guiding member 1 may, in some cases, interfere with the work.

Therefore, on the assembly board, a positioning member for accurately positioning a band clamp binder on an assembling board and not interfering with wiring harness assembling work other than band clamp binding work is desired.

Generally, a lot of band clamps are bound on a wiring harness assembled on the assembling board. If a lot of band clamps are thus bound, cases often occur where all the band clamps have not been bound. Therefore, a device for preventing band clamps from not being bound on the assembly board is desired.

SUMMARY OF THE INVENTION

The present invention has been made under the above described background and has for its principal object to provide a wiring harness assembling board capable of correctly positioning a band clamp binder and accurately binding band clamps in predetermined positions of a bundle of electric wires.

Another object of the present invention is to provide a band clamp binding examining device for examining whether or not all of a predetermined number of band clamps are bound on the above described wiring harness assembling board and informing a worker, if all the band clamps have not been bound, of the fact.

Positions where electric wires are laid out are displayed on the surface of the wiring harness assembling board according to the present invention. Positioning members for a band clamp binder are disposed in predetermined positions related to the display of the positions where electric wires are laid out. The predetermined positions are positions corresponding to the binding positions of the band clamps.

The positioning member comprises a catching space (an engaging portion) engaged with a part of the band clamp binder for positioning the binder. Preferably, the positioning member is provided with an operating member for operating a binding operation starting member provided for the band clamp binder when a part of the binder is engaged with the catching space. The operating member is formed of, for example, a pin made of a metal.

If the wiring harness assembling board of the above described construction is used, it is possible to correctly bind the band clamps in predetermined positions of a bundle of electric wires when the band clamps are bound on the bundle of electric wires using the band clamp binder. Furthermore, if positioning members of favorable construction are used, the operation of the band clamp binder can be automatically started, thereby making it possible to improve the workability of the wiring harness assembling board.

The band clamp binding examining device according to the present invention is applied to the above described wiring harness assembling board, to examine the binding of the band clamps. Signals from a plurality of positioning members disposed on the wiring harness assembling board are applied to the binding examining device. Each of the positioning members outputs signals if a part of the band clamp binder is engaged therewith. The band clamp binding examining device comprises a circuit for counting the signals applied from each of the positioning members and judging whether or not the number of signals coincides with a predetermined number of band clamps to be bound. When the judging circuit does not judge the coincidence within a predetermined time period, a worker is informed that all of the band clamps have not been bound.

Therefore, the use of the band clamp binding examining device according to the present invention makes it possible to prevent the band clamps from not being bound in assembling a wiring harness on the wiring harness assembling board and binding the band clamps and to inform a worker, when all the band clamps have not been bound, of the fact. Consequently, it is possible to manufacture a standard wiring harness in which all band clamps are bound.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Embodiments of the present invention will be described in detail with reference to the drawings.

Figure 1:
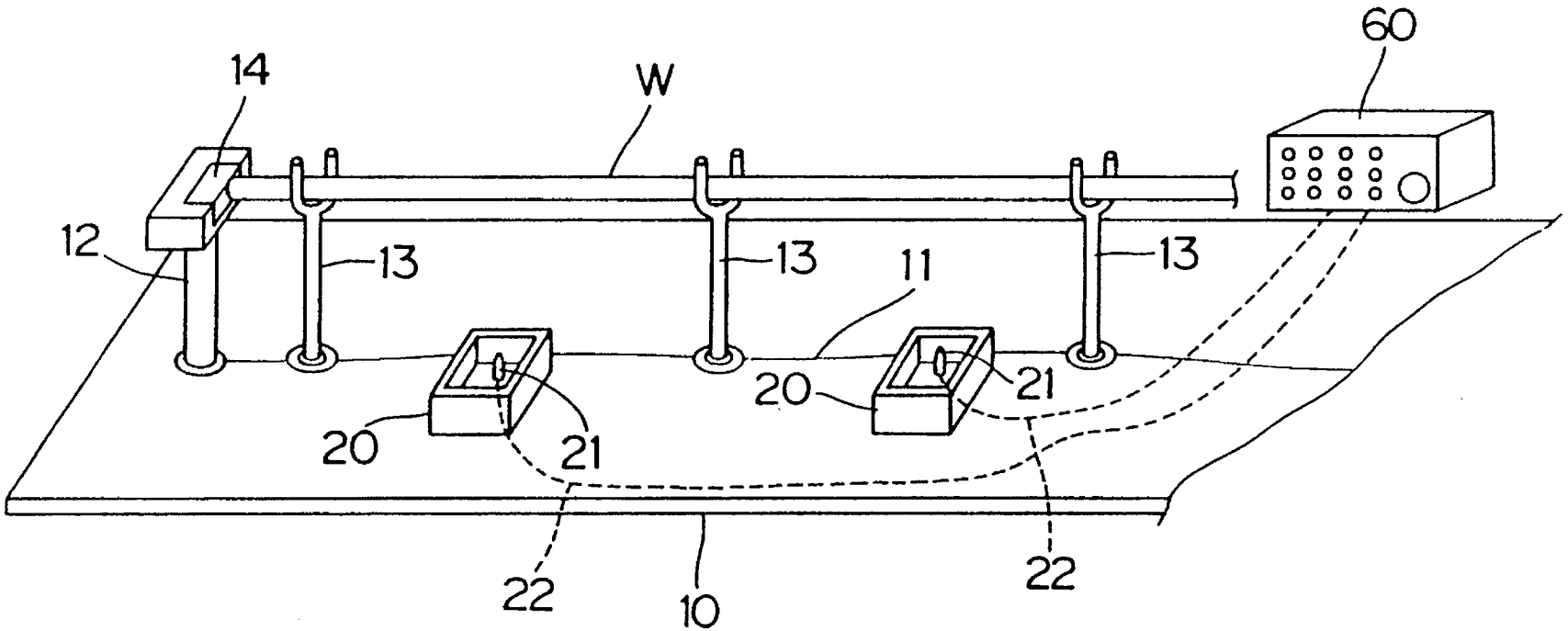
FIG. 1 is a perspective view showing how a wiring harness is assembled using a wiring harness assembling board according to one embodiment of the present invention.

FIG. 1 is a perspective view showing how a wiring harness is assembled using a wiring harness assembling board according to one embodiment of the present invention.

Referring to FIG. 1, a wire laying-out drawing 11 indicating positions where electric wires are laid out (only one solid line is illustrated in FIG. 1, unlike the actual wire laying-out drawing) is displayed on the surface of an assembling board 10. In addition, predetermined types of holding members 12 and 13 are respectively studded in predetermined positions along the wire laying-out drawing 11 on the assembling board 10. At the time of assembling a wiring harness, a connector 14, for example, is caught by the holding member 12, and electric wires W are held by the holding members 13, as shown in FIG. 1.

Positioning members 20 for a band clamp binder are further disposed on the assembling board 10. The positioning members 20 are disposed in predetermined positions related to the display of the wire laying-out drawing 11. The positioning members 20 are lower than the holding members 12 and 13. Accordingly, the positioning members 20 do not interfere with, for example, work for winding a tape around the electric wires W. The positioning members 20 are respectively provided with operating pins 21 for causing the band clamp binder to start its operation as described later, and signal lines 22 are respectively connected to the operating pins 21. Each of the signal lines 22 extends through the reverse surface of the assembling board 10 and is connected to a clamp binding examining device 60. The structure and the function of the clamp binding examining device 60 will be described later.

Figure 2A:
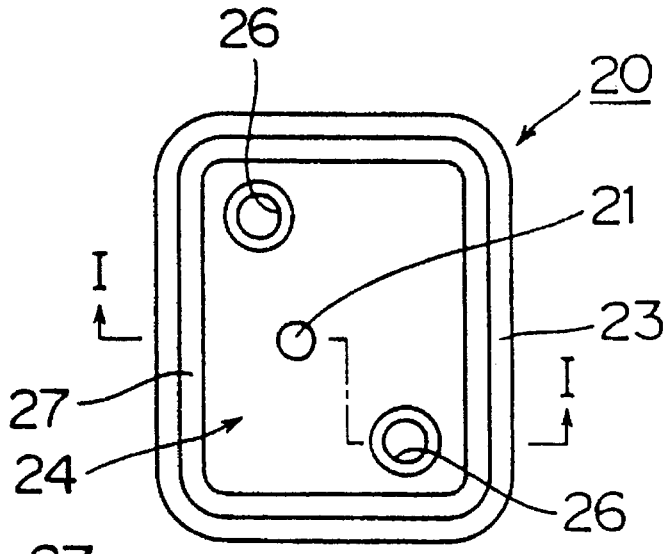
FIGS. 2A and 2B are diagrams showing a structure of a positioning member of a band clamp binder.
Figure 2B:
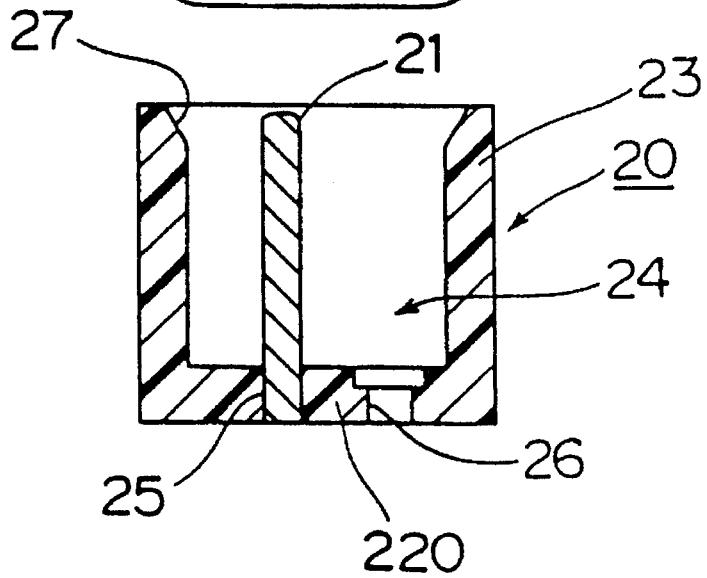

FIGS. 2A and 2B are diagrams showing the structure of the positioning member 20 of the band clamp binder mounted on the above described assembling board 10, where FIG. 2A is a plan view, and FIG. 2B is a cross sectional view taken along a line I—I in FIG. 2. Referring to FIGS. 2A and 2B, the positioning member 20 comprises a bottom portion 220 which is rectangular in plan view and a sidewall portion 23 extending upward from the periphery of the bottom portion 220. The bottom portion 220 and the sidewall portion 23 are integrally formed of resin such as polyester. A catching space (an engaging portion) 24 which has a bottom and opens upward is constituted by the bottom portion 220 and the sidewall portion 23. The lower portion of the band clamp binder is inserted into the catching space 24, as described later.

A through hole 25 extending upward and downward is formed in the bottom portion 220, and a lower end of the operating pin 21 is inserted into the through hole 25. Consequently, the operating pin 21 is studded in the catching space 24. The operating pin 21 is made of a metal material having conductive properties such as stainless or aluminum. The operating pin 21 may be significantly lower than the sidewall portion 23, although the height thereof is approximately equal to that of the sidewall portion 23 in the catching space 24 in FIG. 2B.

Two mounting holes 26 are further formed in the bottom portion 220. The mounting holes 26 are holes in which mounting screws are to be fitted in mounting the positioning member 20 on the assembling board 10 (see FIG. 1).

An upper inner edge of the sidewall portion 23 is a tapered surface 27 opening outward, into which the lower portion of the band clamp binder is easily inserted. The tapered surface 27 need not be particularly formed depending on the mode of the positioning member 20.

Figure 3A:
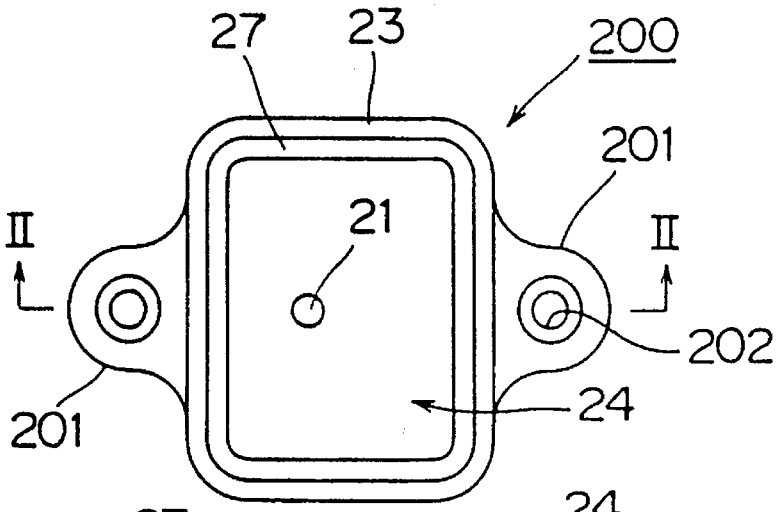
FIGS. 3A and 3B are diagrams showing another structure of a positioning member of a band clamp binder.
Figure 3B:
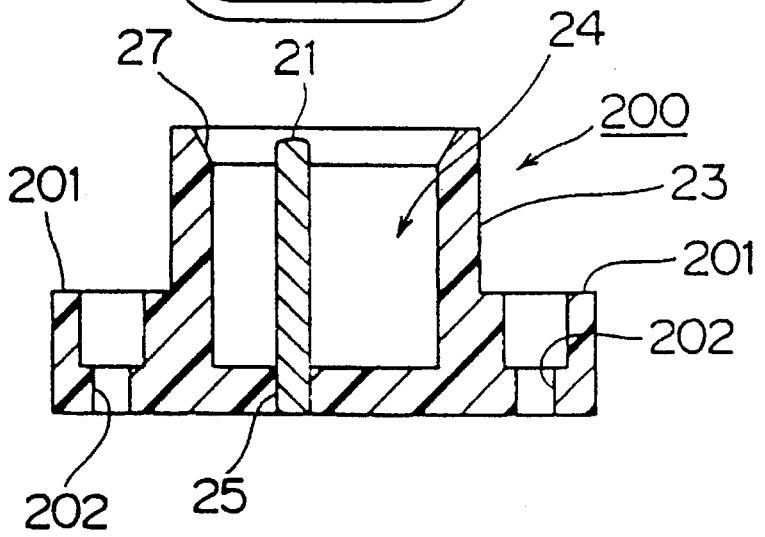

FIGS. 3A and 3B are diagrams showing a positioning member 200 of a band clamp binder according to another embodiment, wherein FIG. 3A is a plan view, and FIG. 3B is a cross sectional view taken along a line II—II in FIG. 3A.

Since the positioning member 200 shown in FIGS. 3A and 3B is the same as the positioning member 20 shown in FIGS. 2A and 2B except that a mounting portion 201 required in mounting the positioning member 200 on a wiring harness assembling board is formed outside of a catching space 24, that is, outside of a sidewall portion 23, the same or corresponding portions are assigned the same reference numerals and hence, the description thereof is not repeated.

The mounting portion 201 provided outside of the sidewall portion 23 is projected outward from the sidewall portion 23. A mounting hole 202 is formed in the mounting portion 201. In mounting the positioning member 200 on the assembling board, a mounting screw is fitted in the mounting hole 202, and the screw is pressed into the assembling board.

Figure 4:
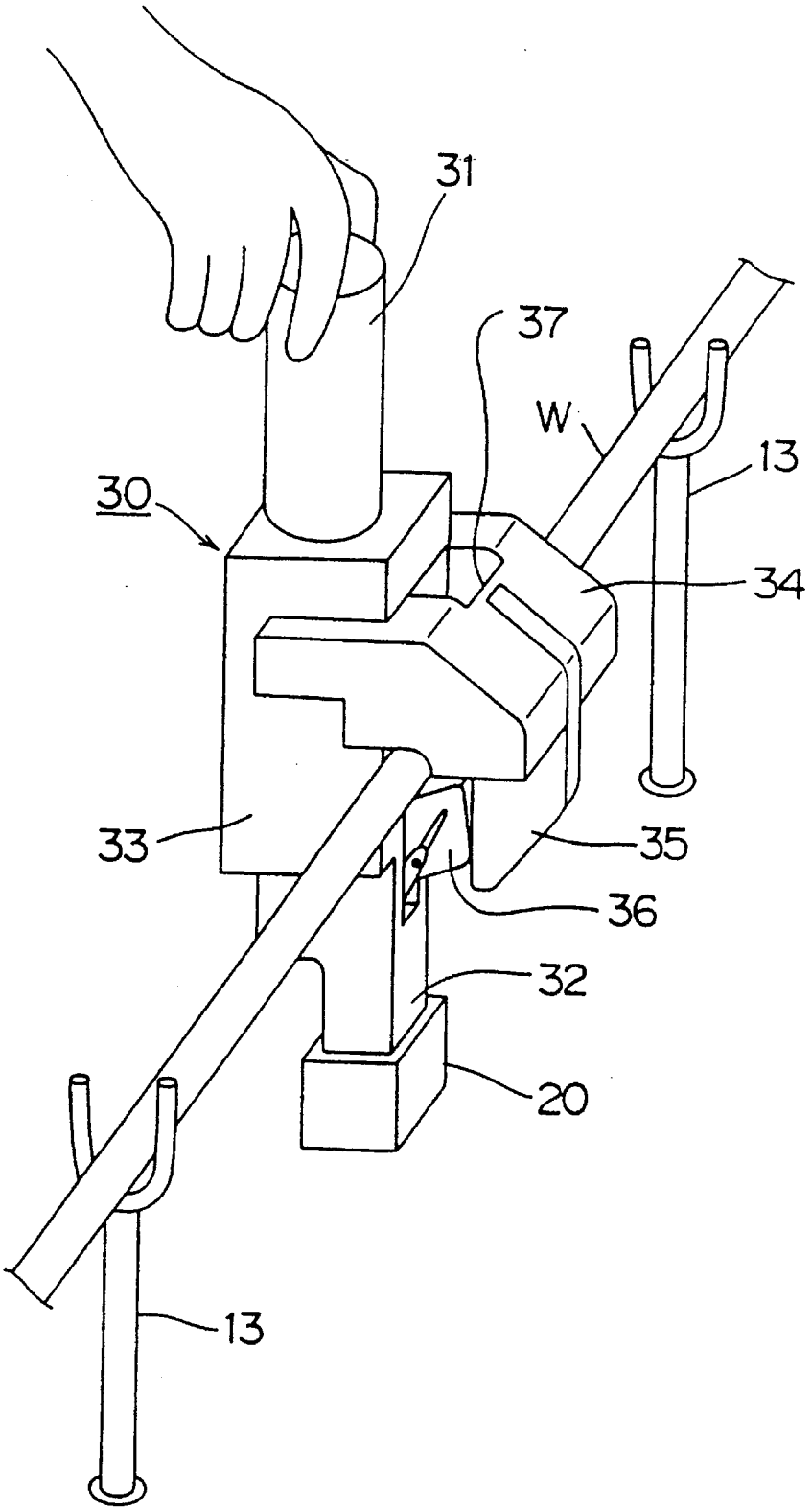
FIG. 4 is a perspective view showing a state where a band clamp binder is positioned by a positioning member according to one embodiment of the present invention, to bind a band clamp.

FIG. 4 is a perspective view showing a state where a band clamp is bound on electric wires W laid out on the above described assembling board 10 by a band clamp binder 30. As shown in FIG. 4, a lower portion 32 of the binder 30 is inserted into a positioning member 20 with a circular cylindrical handle 31 projected upward of the band clamp binder 30 grasped with a worker's hand, thereby to position the binder 30.

The band clamp binder 30 comprises a main body 33, a projected portion 34 projected sideward from the main body 33, and a beak portion 35 projected so as to hang downward from the projected portion 34. When the lower portion 32 is inserted into the positioning member 20 as shown, the electric wires W are positioned in an enclosure formed by the main body 33, the projected portion 34 and the beak portion 35.

Furthermore, if the lower portion 32 is engaged with the positioning member 20, a guiding member 36 is projected from the main body 33, and is positioned below the electric wires W. The band clamp binder 30 automatically starts to perform a clamping operation in this state, so that a band clamp is bound on the electric wires W.

A band clamp inserting hole 37 for inserting a band clamp is formed in the projected portion 34. The band clamp is inserted from the inserting hole 37 and is set in the binder 30. In addition, a hole into which the above described operating pin 21 (see FIGS. 2A and 2B) can be inserted is formed on the lower surface of the lower portion 32.

FIGS. 5A to 5D are illustrations showing how a band clamp 40 is bound on the electric wires W by the band clamp binder 30.

Figures 5A, 5B, 5C, 5D:
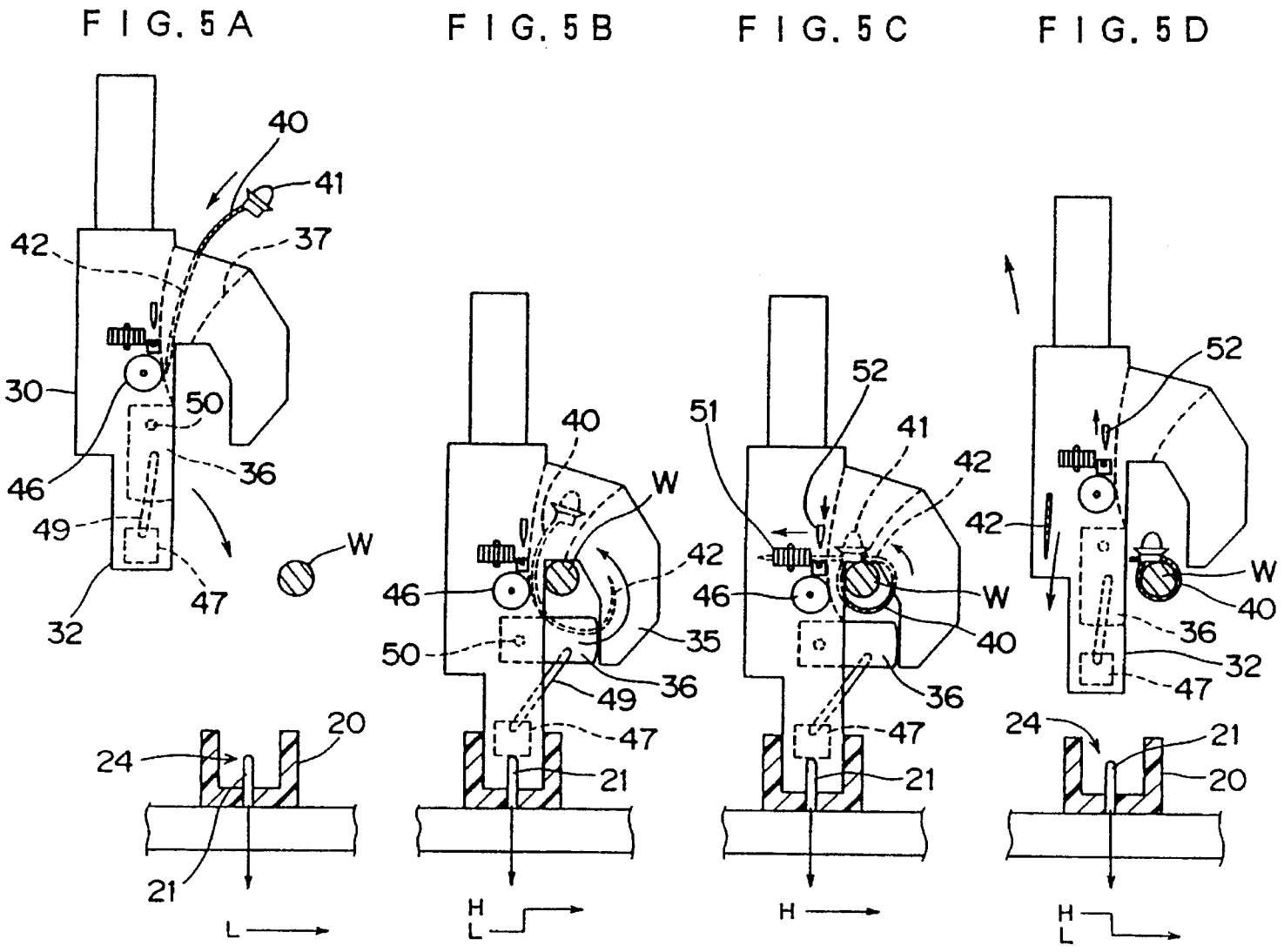
FIGS. 5A, 5B, 5C and 5D are illustrations showing the procedure for positioning a band clamp binder using a positioning member according to one embodiment of the present invention, to bind a band clamp.

Referring to FIGS. 5A to 5D, description is made of the binding of the band clamp 40. First, the band clamp 40 is set in the binder 30, as shown in FIG. 5A. This setting is achieved by inserting the band clamp 40 into the inserting hole 37, as described above. In this case, the band clamp 40 is inserted into the inserting hole 37 from the top end of a band portion 42 so that a clamp portion 41 of the band clamp 40 is positioned on the upper side. Consequently, the top end of the band portion 42 is engaged with a feeding gear 46 contained in the binder 30.

In this state, the lower portion 32 of the binder 30 is inserted into the catching space 24 of the positioning member 20 (see FIG. 5A).

If the lower portion 32 of the binder 30 is inserted into the catching space 24 of the positioning member 20, the operating pin 21 enters the lower portion 32 from a hole (not shown) formed in the lower surface of the lower portion 32. A start shutter 47 is provided in the lower portion 32 of the binder 30. If the operating pin 21 enters the lower portion 32, the start shutter 47 is pushed up by the upper end of the operating pin 21 (see FIG. 5B). If the start shutter 47 is moved upward, the guiding member 36 connected to the start shutter 47 by a connecting bar 49 is rotated counter clockwise around a support 50, to enter an approximately horizontal state. Consequently, the guiding member 36 and the beak portion 35 of the binder 30 constitute a guide path of the band clamp 40.

If the guiding member 36 enters the horizontal state, a motor (not shown) contained in the binder 30 is automatically started, so that the feeding gear 46 is rotated. Accordingly, the band portion 42 of the band clamp 40 engaged with the feeding gear 46 is so fed as to be rotated counter clockwise around the electric wires W along the guiding member 36 and the beak portion 35.

Furthermore, as shown in FIG. 5B, when the lower portion 32 of the binder 30 is inserted into the positioning member 20, the operating pin 21 and the start shutter 47 are brought into contact with each other, so that a signal is applied to the operating pin 21 from the start shutter 47. For example, a battery or the like is contained in the binder 30, the start shutter 47 is made of a metal, and a potential (for example, a potential of approximately 1 V) is applied to the start shutter by the battery. Consequently, the top end of the operating pin 21 is brought into contact with the start shutter 47, so that the potential of the operating pin 21 is relatively changed from a low potential L (for example, 0 V) to a high potential H (for example, 1 V).

The change in the potential of the operating pin 21 from L to H is detected by a clamp binding examining device 60, as described later.

Description is now made with reference to FIG. 5C. The band clamp 40 is fed by the feeding gear 46, whereby the top end of the band portion 42 enters a buckle hole formed at the root of the clamp portion 41. If the band clamp 40 is further fed by the feeding gear 46, the top end of the band portion 42 is engaged with a clamping gear 51. The top end of the band portion 42 is fed leftward in the figure by the clamping gear 51. Consequently, the band clamp 40 is bound on the electric wires W so as to clamp the periphery of the electric wires W.

When the clamping of the band clamp 40 by the clamping gear 51 is terminated, the clamping gear 51 cannot be further rotated, so that torque produced by a motor (not shown) for rotating the clamping gear 51 is increased. A cutter 52 is operated utilizing the increase in torque as its sign, so that an extra portion in the top end of the band portion 42 of the band clamp 40 is cut.

If the cutting of the band portion 42 is completed, a termination lamp (not shown) lights up, or a termination buzzer sounds. In addition, a motor for rotating the feeding gear 46 and the clamping gear 51 is stopped as the termination lamp lights up or the termination buzzer sounds. Since the termination lamp or termination buzzer is provided by way of caution because a worker can know that the band clamp has been bound even if there is no termination lamp or termination buzzer, the termination lamp or termination buzzer may be omitted.

After the binding of the band clamp 40 is terminated, a worker pulls the band clamp binder 30 upward. Consequently, the lower portion 32 of the binder 30 is pulled out of the catching space 24 of the positioning member 20, whereby the start shutter 47 falls downward. Accordingly, the guiding member 36 is contained in the binder 30 (see FIG. 5D).

The cut band portion 42 drops to a portion outside of the binder 30.

Furthermore, the start shutter 47 is not brought into contact with the operating pin 21 provided for the positioning member 20, so that the potential of the operating pin 21 is decreased from H to L.

As apparent from the foregoing description, according to the present embodiment, the lower portion 32 of the band clamp binder 30 is inserted into the catching space 24 of the positioning member 20, thereby making it possible to position the binder 30. The band clamp 40 can be bound in a predetermined position of the electric wires W by the positioned binder 30.

Furthermore, according to the present embodiment, the binder 30 can be caused to start the binding operation of the band clamp only by inserting the lower portion 32 of the binder 30 into the catching space 24 of the positioning member 20. Consequently, a switch for starting the binder 30 need not be operated after the binder 30 is positioned. Accordingly, the binding work becomes easier. That is, the pressing operation of the start switch need not be performed.

Figure 6:
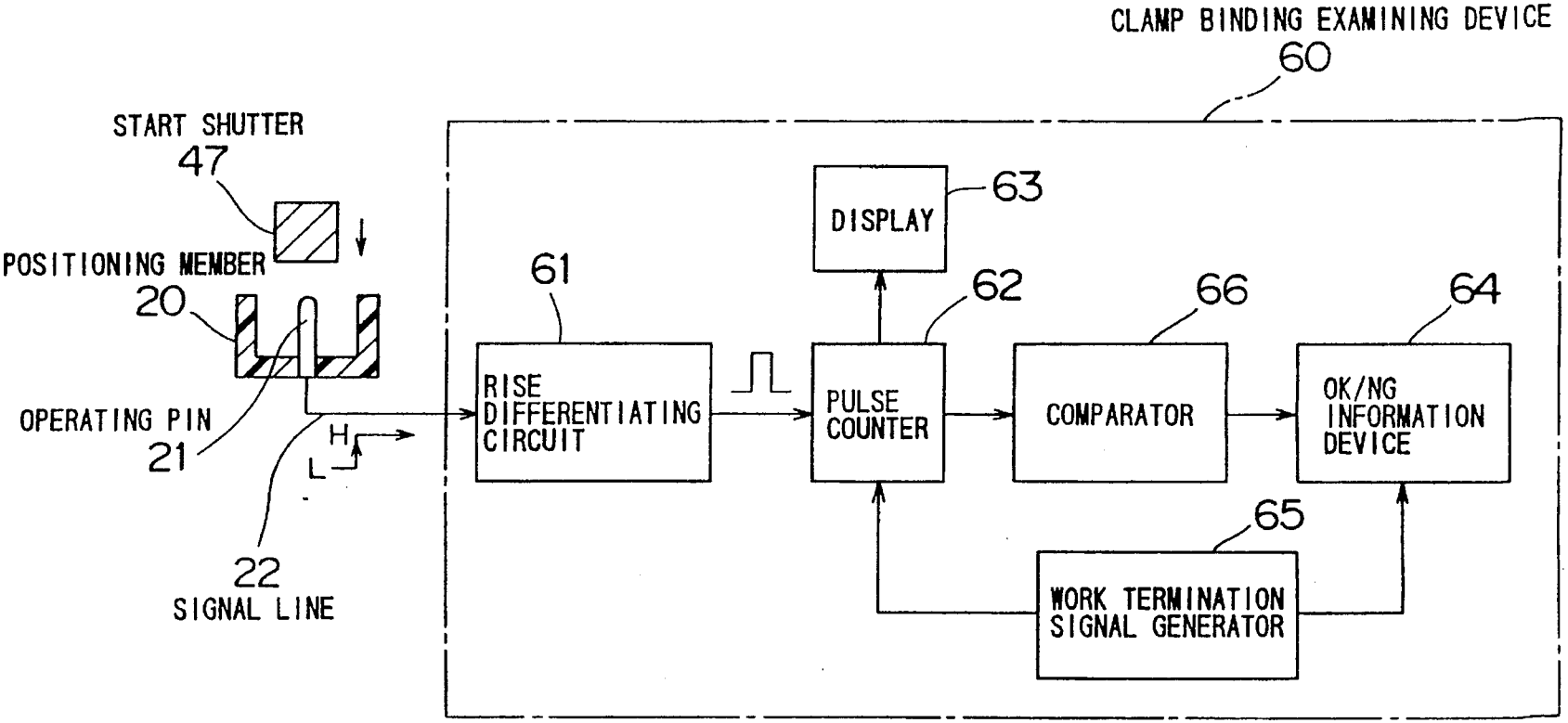
FIG. 6 is a circuit block diagram for explaining the electrical construction and the operation of a clamp binding examining device.

FIG. 6 is a circuit block diagram showing the electrical construction of the clamp binding examining device 60.

Referring to FIG. 6, the signal line 22 is connected to a lower end of the operating pin 21 provided for the positioning member 20, and the signal line 22 is connected to the clamp binding examining device 60. Consequently, the clamp binding examining device 60 examines the change in the potential of the operating pin 21, that is, whether the potential of the operating pin 21 is L or H.

The clamp binding examining device 60 comprises a rise differentiating circuit 61 connected to the signal line 22. As shown in FIGS. 5A and 5B, if the lower portion 32 of the band clamp binder 30 is inserted into the positioning member 20, a potential applied to the rise differentiating circuit 61 is changed from L to H. Consequently, the rise differentiating circuit 61 differentiates the change in the potential from L to H, to output a pulse signal.

The pulse signal outputted from the rise differentiating circuit 61 is applied to a pulse counter 62 and is counted therein. In addition, a count value of the pulse counter 62 is displayed on a display device 63. The display device 63 may be a numerical display device for displaying, for example, the count value itself or may be a display device in which lamps (the number of which correspond to the count value) light up.

The count value of the pulse counter 62 is also applied to a comparator 66. If the number of band clamps to be bound by the band clamp binder 30 on a predetermined reference number of assembling boards (for example, one assembling board) 10 (see FIG. 1) is n (n: a natural number), the reference number n is previously set in the comparator 66. The comparator 66 compares the count value applied from the pulse counter 62 with the reference number n, to output a coincidence output to an OK/NG information device 64 if both coincide with each other.

The clamp binding examining device 60 further comprises a work termination signal generator 65. The work termination signal generator 65 outputs a termination signal every time predetermined work time on, for example, one assembling board 10 (see FIG. 1) expires. Alternatively, the work termination signal generator 65 may include a switching member switched by an engaging projection provided in a rear edge, for example, of the assembling board 10. In this case, the assembling board 10 is moved at a low speed, so that the projection provided in the rear edge of the assembling board 10 presses a switching element, thereby to generate a work termination signal.

Thus, the work termination signal generator 65 may be one for generating a signal at the time point where wiring harness assembling work on one assembling board 10 is terminated.

The work termination signal generated by the work termination signal generator 65 is applied to the OK/NG information device 64. The OK/NG information device 64 judges whether or not a coincidence signal is applied from the comparator 66 when the termination signal is applied. When work is normally performed on the assembling board 10 to bind a predetermined number of band clamps, the coincidence signal is outputted from the comparator 66. When the termination signal is applied, therefore, the coincidence signal is applied if the work is normal. In this case, the information device 64 gives "OK information".

On the other hand, a case where no coincidence signal is applied from the comparator 66 when the termination signal is applied means that all the band clamps have not been bound, for example, irrespective of the termination of the work on the assembling board 10. In this case, therefore, the information device 64 gives "NG information".

Furthermore, the termination signal of the work termination signal generator 65 is applied to the pulse counter 62, so that the pulse counter 62 is cleared in preparation for the subsequent counting for the assembling board 10.

In the clamp binding examining device 60, it is thus judged whether or not the binding of a predetermined number of clamps is completed every time the work is terminated, to give "OK information" if the binding is completed, while giving "NG information" if the binding is not completed. Therefore, it is possible to inform a worker that the binding of a required number of band clamps is completed on one assembling board 10. Further, if all the band clamps have not been bound, the worker is informed of the fact, thereby making it possible to prevent the band clamps from not being bound.

The above described circuit arrangement of the clamp binding examining device 60 is only an example. Another circuit arrangement may be used, provided that it is judged on the basis of a signal from the operating pin 21 whether or not a required number of band clamps are bound on one assembling board, to inform a worker of the results of the judgment.

When "NG information" is given, the worker watches the display on the display device 63, thereby to make it possible to confirm which band clamp has not been bound or how many band clamps have not been bound.

Figure 7A:
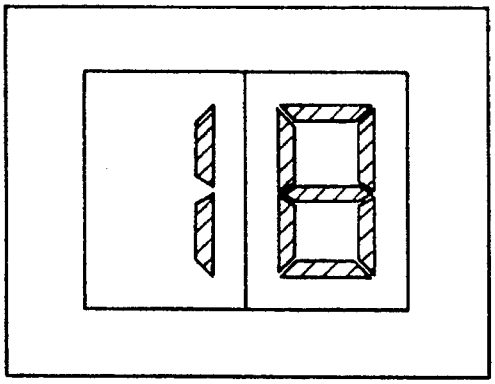
FIGS. 7A and 7B are diagrams showing an example of display on a display device.
Figure 7B:
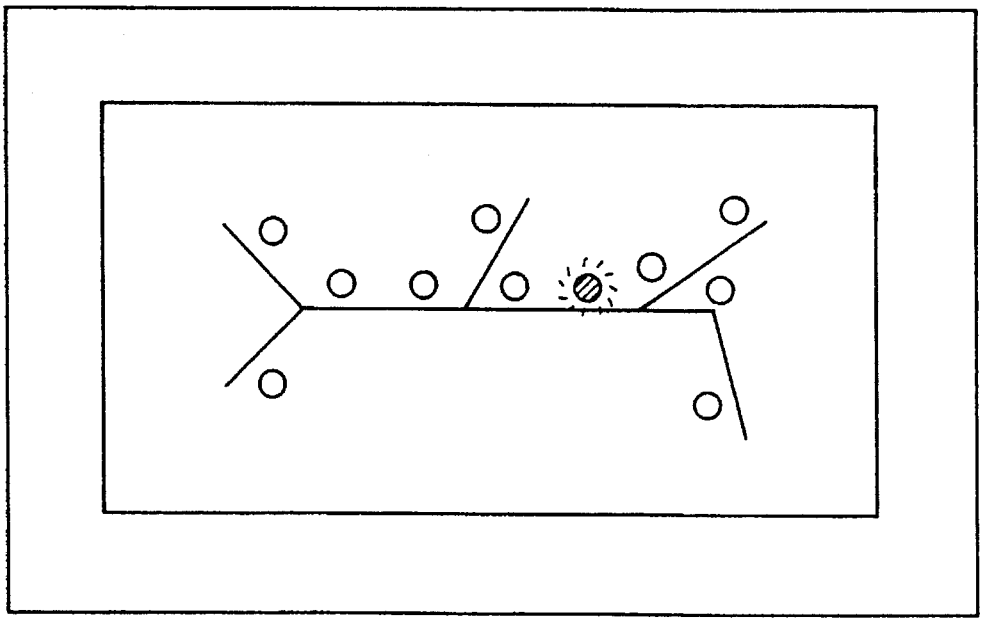
Figure 8:
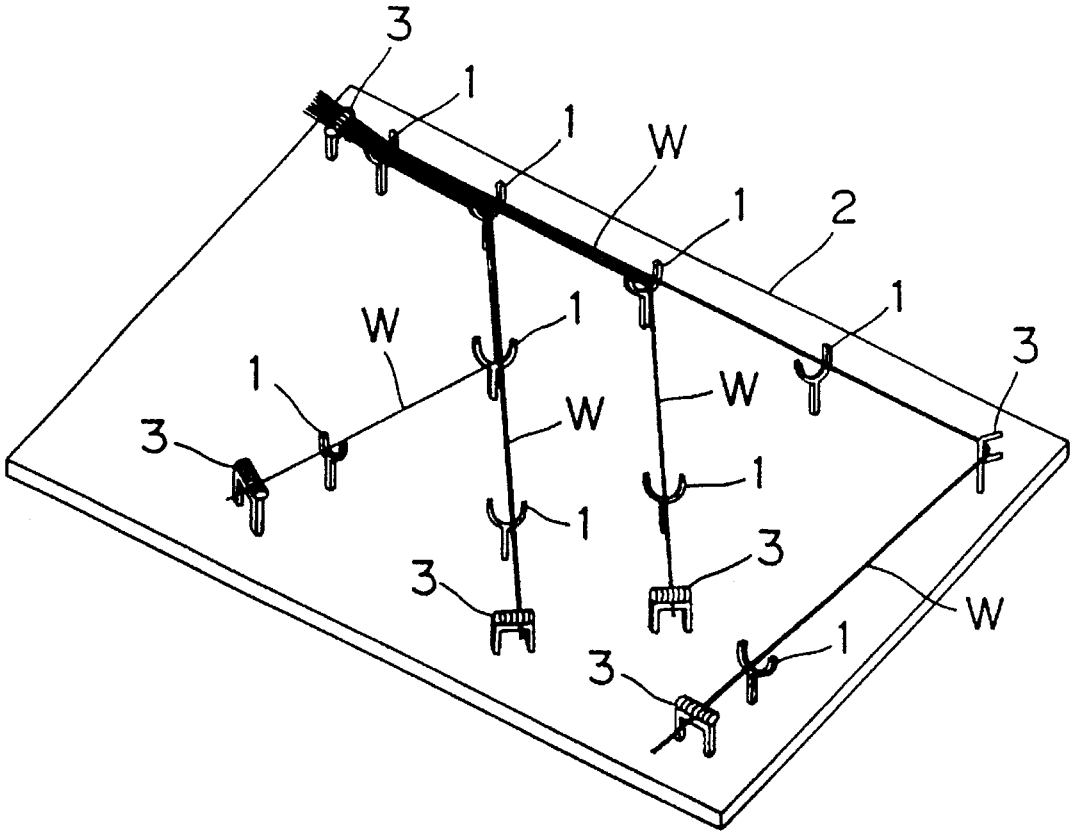
FIG. 8 is a perspective view showing an assembling board having a conventional band clamp guiding member.
Figure 9:
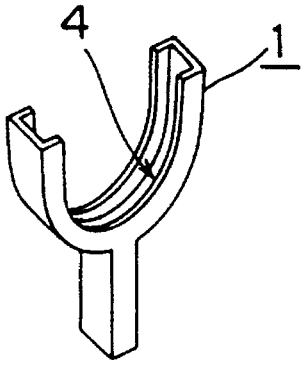
FIG. 9 PRIOR ART
FIG. 9 is a perspective view showing a conventional band clamp guiding member.

FIGS. 7A and 7B illustrate an example of the display on the display device 63. In the display shown in FIG. 7A, only the number of band clamps bound is represented by a numerical value. When the "NG information" is given, therefore, the worker can know by the display how many band clamps have not been bound.

In the display shown in FIG. 7B, the positions of the band clamps which have not been bound are displayed. Specifically, the display shown in FIG. 7B includes the entire shape of a wiring harness and the binding positions of the band clamps in the entire shape. Lamps are respectively provided in the binding positions of the band clamps. If the band clamp is bound, a lamp corresponding to the binding position thereof goes out. Therefore, the position of the lamp lighting up is the position where the band clamp has not been bound. Therefore, the worker can confirm which band clamp has not been bound.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A wiring harness assembling board, on which positions where wires are to be laid out are displayed, the assembling board comprising:

a plurality of wire holding members positioned relative to the display of the positions where wires are to be laid out on said assembling board; and a plurality of positioning members positioned relative to the display of the positions where wires are to be laid out on said assembling board, each of said positioning members having a catching space for engaging an engageable part of a band clamp binder of a predetermined type for positioning the binder, and an operating means for operating a binding operation starting member of the binder when the engageable part of the binder is engaged with said catching space.

2. The wiring harness assembling board according to claim 1, wherein said operating means has a pin body composed of a conductive material, which pin body is studded in the catching space of the positioning member.

3. A wiring harness assembling board according to claim 1, wherein each of the positioning members further include a mounting portion for mounting the member on said assembling board, and the operating means has a pin body provided in said catching space.

4. A wiring harness assembling board comprising:

an assembling board body;

positions displayed on the surface of said assembling board body where wires are to be laid out;

a plurality of wire holding members positioned relative to said positions where wires are to be laid out on the assembling board body;

a plurality of positioning members for use with a band clamp binder of a predetermined type, which positioning members are positioned relative to said positions where wires are to be laid out;

signal outputting means provided for each of the positioning members, for outputting signals in response to the engagement of a part of said band clamp binder with the positioning member;

judging means for receiving the signals from each of said signal outputting means and judging whether or not the number of signals received has reached a predetermined number; and information means for informing a worker of the results of the judgment made by said judging means.

5. The wiring harness assembling board according to claim 4, wherein said judging means further judges whether or not the number of signals received coincides with the number of positioning members mounted on said assembling board body.

6. The wiring harness assembling board according to claim 5, wherein said information means informs a worker of passing when the number of signals received by said judging means reaches the predetermined number.

7. A band clamp binding examining device which is applicable to a wiring harness assembling board having positioning members which are engageable with a part of an automatic band clamp binder for positioning the binder while binding band clamps on a bundle of wires, the wiring harness assembling board having positioning members disposed in a plurality of predetermined positions on the board, the band clamp binding examine device comprising:

a plurality of signal outputting means respectively provided for said plurality of positioning members for outputting signals in response to the engagement of a part of said automatic band clamp binder with the positioning members;

judging means for receiving the signals outputted from each of said signal outputting means and judging whether or not the number of signals received coincides with the number of positioning members mounted on said assembling board; and means for informing a worker of passing when said judging means judges coincidence.

8. The band clamp binding examining device according to claim 7, wherein said positioning member includes operating means for operating a binding operation starting member provided by the automatic band clamp binder when a part of the automatic binder is engaged therewith, and said signal outputting means includes the operating means.

9. A band clamp binding examining method using an automatic band clamp binder, comprising:

respectively disposing positioning members in a plurality of predetermined positions on a wiring harness assembling board, positioning the automatic band clamp binder by engaging a part of the automatic binder with said positioning members, and binding band clamps on a bundle of wires by the automatic binder in a state where the automatic binder is positioned;

providing signal outputting means for outputting signals when a part of the automatic band clamp binder is engaged with said positioning members;

counting signals from the signal outputting means; and informing a worker of passing when the count value of output signals coincides with the number of band clamps to be bound.

* * * * *